US012612795B2

(12) United States Patent
Stone et al.

(10) Patent No.: US 12,612,795 B2
(45) Date of Patent: Apr. 28, 2026

(54) METHOD FOR FABRICATION OF MODULAR BUILDINGS

(71) Applicant: Level Headed Holdings, LLC, Alachua, FL (US)

(72) Inventors: Benjamin Stone, Alachua, FL (US); Daniel Eckhard, Alachua, FL (US)

(73) Assignee: Level Headed Holdings, LLC, Alachua, FL (US)

( * ) Notice: Subject to any disclaimer, the term of this patent is extended or adjusted under 35 U.S.C. 154(b) by 350 days.

(21) Appl. No.: 18/340,424

(22) Filed: Jun. 23, 2023

(65) Prior Publication Data

US 2024/0426119 A1 Dec. 26, 2024

(51) Int. Cl.
*E04H 1/00* (2006.01)
*E04H 1/02* (2006.01)

(52) U.S. Cl.
CPC ..... *E04H 1/005* (2013.01); *E04H 1/02* (2013.01)

(58) Field of Classification Search
CPC ..... E04H 1/005
See application file for complete search history.

(56) References Cited

U.S. PATENT DOCUMENTS 2,037,895 A 4/1936 Gugler
4,599,829 A 7/1986 DiMartino, Sr.
4,891,919 A * 1/1990 Palibroda ..... E04B 1/34321 52/79.5
5,867,964 A 2/1999 Perrin
8,186,110 B2 * 5/2012 Green ..... E04B 1/34807 52/79.9
9,115,504 B2 * 8/2015 Wallance ..... E04B 1/34336
9,121,168 B2 * 9/2015 Levy ..... E04B 1/3483
9,464,428 B2 * 10/2016 Esposito ..... E04B 1/35
11,365,540 B2 6/2022 Wheeler et al.
2005/0188632 A1 9/2005 Rosen
2008/0134589 A1 * 6/2008 Abrams ..... E04B 1/34807 52/79.1

(Continued)

FOREIGN PATENT DOCUMENTS

ES 2925316 A1 10/2022

OTHER PUBLICATIONS

BMC, Modular Construction: Reinventing the Building Process, BigRentz, https://www.bigrentz.com/blog/modular-construction, Mar. 9, 2022.

(Continued)

*Primary Examiner* — Joshua K Ihezie
(74) *Attorney, Agent, or Firm* — Lathrop GPM LLP; Robert J. Lambrechts

(57) ABSTRACT

A method for the construction of a habitable structure. The method including the receiving of a module consisting of four walls, a ceiling, and a floor. Next the method requires the reviewing of a set of shop drawings to determine the required modifications to the module to fabricate at least one bathroom and a kitchen within the interior of the module. The method requires installing framing, plumbing and electrical consistent with the shop drawings and then transferring the module to a job site where it is attached to a pad or a foundation. Next the method requires the constructing of additional living space around the footprint of the module and within the perimeter of the at least one of the pad or the foundation.

15 Claims, 7 Drawing Sheets

(56) References Cited

U.S. PATENT DOCUMENTS

| | | | | |
|---|---|---|---|---|
| 2010/0018131 | A1* | 1/2010 | Green | E04B 1/24 52/79.5 |
| 2016/0160515 | A1* | 6/2016 | Wallance | E04F 10/10 52/745.02 |
| 2020/0265175 | A1* | 8/2020 | Martin | G06F 3/04815 |

OTHER PUBLICATIONS

SCOMMCHH, Shipping Containers Outperform Modular Construction. Here's How., Boxman Studios, https://boxmanstudios.com/blog/modular-construction/shipping-containers-outperform-modular-construction-heres-how/, Aug. 1, 2019.

* cited by examiner

METHOD FOR FABRICATION OF MODULAR BUILDINGS

FIELD

This disclosure relates to a method for mass fabrication of modular building components for use within a habitable structure.

BACKGROUND

Construction problems are all too common throughout a project's life cycle. Project managers tasked with ensuring projects remain on schedule, within budget, compliant with safety regulations, and running smoothly know that it can be difficult with the amount of potential and unanticipated issues that tend to occur.

Among the top construction industry problems is cost overrun, or when a project exceeds its pre-planned budget. A Mckinsey study estimates that 98% of large construction projects deal with cost overruns of more than 30%. It is often caused by poor cost estimates during the planning phase, design change requests, and payment delays.

The result is lowered profit margins, material shortages due to the lack of a remaining budget, damage to the construction firm's reputation, and delays, which is a prevalent industry issue. The same Mckinsey study also states that 77% of construction projects are at least 40% late. Some contributing factors cannot be controlled, such as the weather, the nationwide labor shortage (caused by recessions), and equipment failures. But there are factors that can be prevented, including scheduling issues, project conflicts, and incorrect data. Even the most diligent and conscientious project manager is prone to human error. One of the best ways to mitigate risk is to reduce the need for manual management using technology, but the industry's willingness to adapt can be a problem as well.

Perhaps one of the trickiest problems in the construction industry is its hesitance to adopt new methodologies, which include technologies that could very well make their workplaces more efficient. Even when construction firms acknowledge that there are technological solutions that they could benefit from, budgeting frequently remains quite small for new software platforms and gadgets. Even so, technologies like Bridgit Bench allow construction firms to counteract some of the industry's core problems, such as disorganized workforce management, insufficient scheduling, and inadequate communication.

One of the more everyday construction issues is inadequate communication. Since projects require multiple professionals during the planning stage and many contractors on the job, effective information exchange is crucial for the project's success. Oftentimes, there's a disconnect between the office and on-site workers. Communication inefficiencies are linked to a high percentage of construction problems, with inadequacies resulting in complications such as unrealistic expectations (due to planners not being on the field and being unaware of how long a task may take) and important tasks being overlooked (with teams remaining uninformed about issues until it's too late).

Project managers will need to establish clear guidelines and can keep everyone in the loop by summarizing any obstacles and progress made at the end of each day. Documenting all communication also helps in cases where conflicts arise. Many construction challenges originate from one core issue: the persistent labor shortage. The industry has long been needing more skilled and qualified professionals to build the world's future infrastructure, but it's proven to be difficult for several reasons.

The Great Recession in 2008, for example, saw many skilled workers laid off or leaving the industry and never returning, and the 2019 COVID pandemic only worsened the aggressive labor shortage. Further exacerbating the lack of available labor is older workers retiring and leaving behind a significant skill gap. The younger generation has evidently not been enough to fill the hole, as according to Associated Builders and Contractors, the number of construction workers aged 25 to 54 declined 8% over the past decade. There are many ways to counteract the shortage of young workers, such as investing in new technologies to demonstrate a commitment to efficiency and working with educational institutions to offer apprenticeship programs.

When projects are not properly planned or forecasted, it leads to unachievable goals, which results in construction issues like stagnant productivity. Forecasting may focus too much on the long-term and too little on the short-term. It helps during the planning phase to break a larger goal into smaller and more attainable monthly, weekly, and daily objectives to assess whether it is actually feasible. If not, it is important to communicate the possibility of issues with stakeholders and provide solutions or an alternative plan that adheres to a realistic budget and timeline. In terms of budgeting, incorrect estimates can be detrimental to progress and can see projects delayed or dropped altogether, which is why initially accounting for all expenses is vital to the project's success.

Another one of the prevalent construction problems is lacking organization and haphazard document management. Construction involves dealing with a lot of documentation, from contracts to material orders to receipts to insurance certificates. Manual document management can be inefficient and create room for error. Turning an antiquated system into one that's digital and paperless allows the owner better access, centralizing all important information.

Consequently, there is a strong need to revolutionize the construction industry to address the multitude of challenging issues confronting it.

SUMMARY

There's a strong trend in the real estate industry toward building more things away from the construction site. Modular construction is one approach. For centuries, traditional construction brought all the raw materials to the building site for tradespeople to cut, shape and assemble at the project location. With off-site construction in general, and with modular construction specifically, large portions of the project are fabricated away from the job site. Assembly can take place almost anywhere: from the next town over to an entirely different country. The assembled modules are then shipped and placed on the job site for a completed building.

An obvious advantage is that modular construction allows a chunk of the work to be made in a factory while sitework and foundations are simultaneously performed on the site. This time-saving benefit keeps the project on schedule and speeds up construction time while still being efficient. There is potential to save 30 to 60 percent of overall schedule through a modular approach.

Furthermore, by fabricating the modules inside a controlled environment, worries about weather delaying construction of the modular units is virtually eliminated. It also provides workers safer and more comfortable conditions to be more productive and produce a higher quality product.

Also, the modules arrive on-site usually outfitted with flooring, cabinets, counters, plumbing and electrical fixtures, and appliances, thereby needing little effort and time to be ready for use.

Another advantage of modular construction involves storage of materials. When a site is tight on space, for instance in a compact urban setting, staging and moving materials around is difficult. This causes clutter, slows down work and creates theft concerns. By building the modules in a factory, construction sites can remain cleaner and safer and provide more space to work and move around freely.

An important and potentially controversial advantage involves economics of labor. Skilled labor is in short supply for construction in most places and can be very expensive in cities for a variety of reasons. This leads to real challenges when trying to get a building constructed for a given budget and timeline. Modular allows those coveted skilled workers to remain in fixed locations with controlled and safer conditions as mentioned. Modular plants can be located to attract those competitive workers and take advantage of important access to raw materials and logistic connections, like highways and rail lines, common in other industries, such as automotive and technology products. Savings on labor can vary widely, but there is a potential for up to 25 percent on construction costs.

According to a recent study in the United Kingdom, up to a 90% reduction in materials can be achieved with modular building. With the environment being a growing concern in the construction industry, modular strategies are becoming more popular to limit the amount of waste on each project. There are even efforts to maximize recycling within factories that put the building portions together.

DETAILED DESCRIPTION

The method disclosed herein is directed to the rapid fabrication of a modular component for use in residential, commercial, and industrial construction. In a typical application of the method, a shipping container also known as an intermodal freight container; however, other types of modular containers are also contemplated by this disclosure including those built to specialty dimensions with custom materials.

Cargo container is also defined in the Code of Federal Regulations at 40 CFR § 450.3. It is an article of transport equipment that is: (i) of a permanent character and suitable for repeated use; (ii) especially designed to facilitate the transport of goods, by one or more modes of transport (rail, truck or ship), without intermediate reloading, and (iii) designed to be secured and readily handled, having corner fittings for these purposes. The cargo container is a general-purpose container conforming to ISO 1496-1 and ISO 6346 issued by the International Organization for Standardization.

There are an estimated seventeen million intermodal cargo containers in circulation across the globe and therefore they can be readily acquired for rapid fabrication of a modular component for use in residential, commercial, and industrial construction. The dimensions of a typical intermodal freight container (module) 10 are any of 40' long×8' wide×8'6" high or 20' long×8' wide×8'6" high or 9'9.75"×8' wide×8'6" high with mild variations depending on the selected intermodal freight container.

Figure 1:
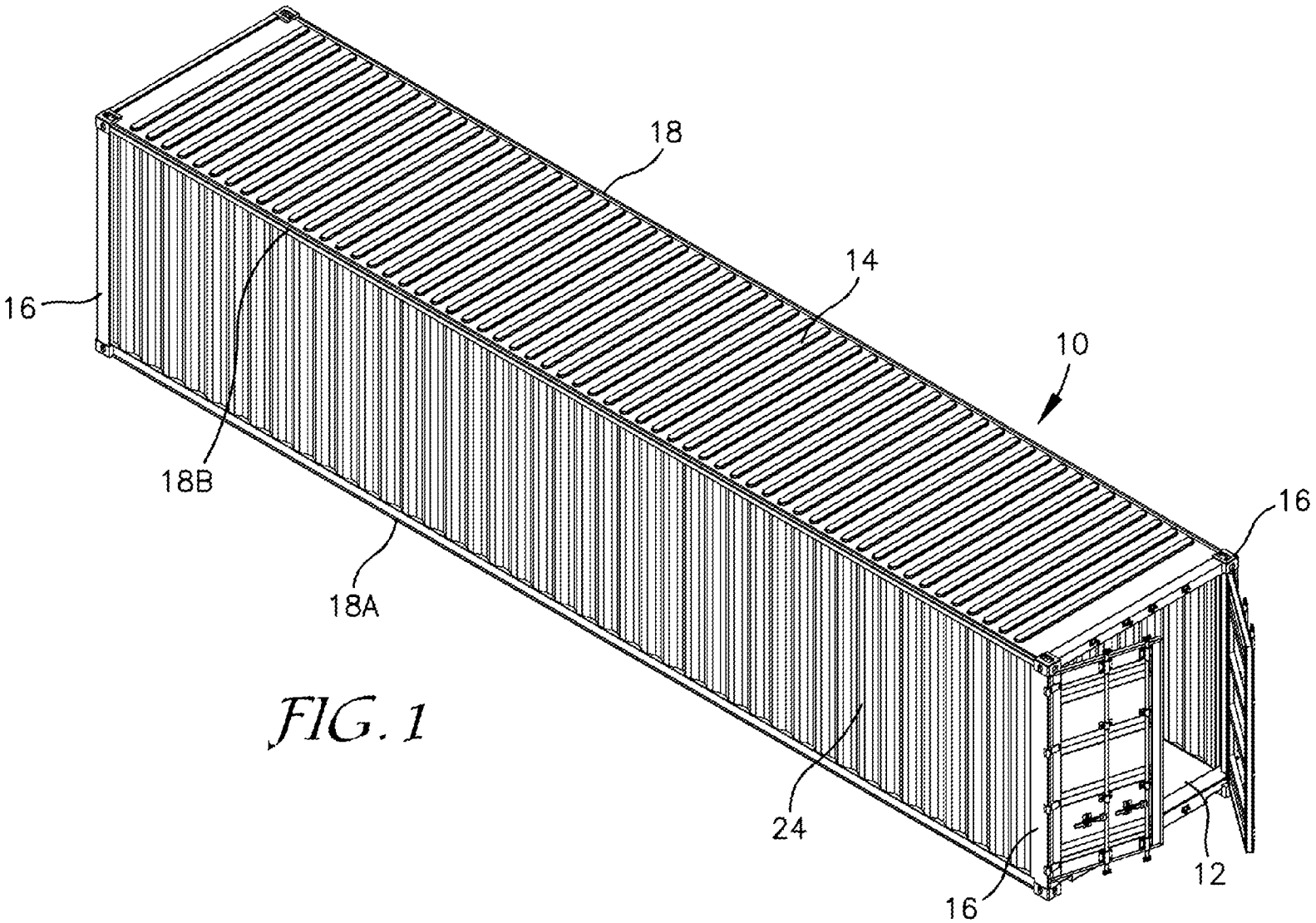
FIG. 1 illustrates an embodiment of a standard intermodal shipping container.

A typical weight for a 40' container is about 8,000 pounds, a 20' container about 5,000 pounds and a 10' container about 2,850 pounds. The modular component, i.e., module 10, includes both a floor 12 and a roof/ceiling 14. As illustrated at FIG. 1, the module walls 24A, 24B, 24C and 24D at a minimum are generally fabricated from corrugated sheet metal; however, other materials such as wood products, engineered polymers, and composites are also contemplated by this disclosure. The floor 12 and roof 14 are secured by fasteners or, alternatively by welding, to both the vertical 16 and the horizontal 18A, 18B structural members.

Figure 2:
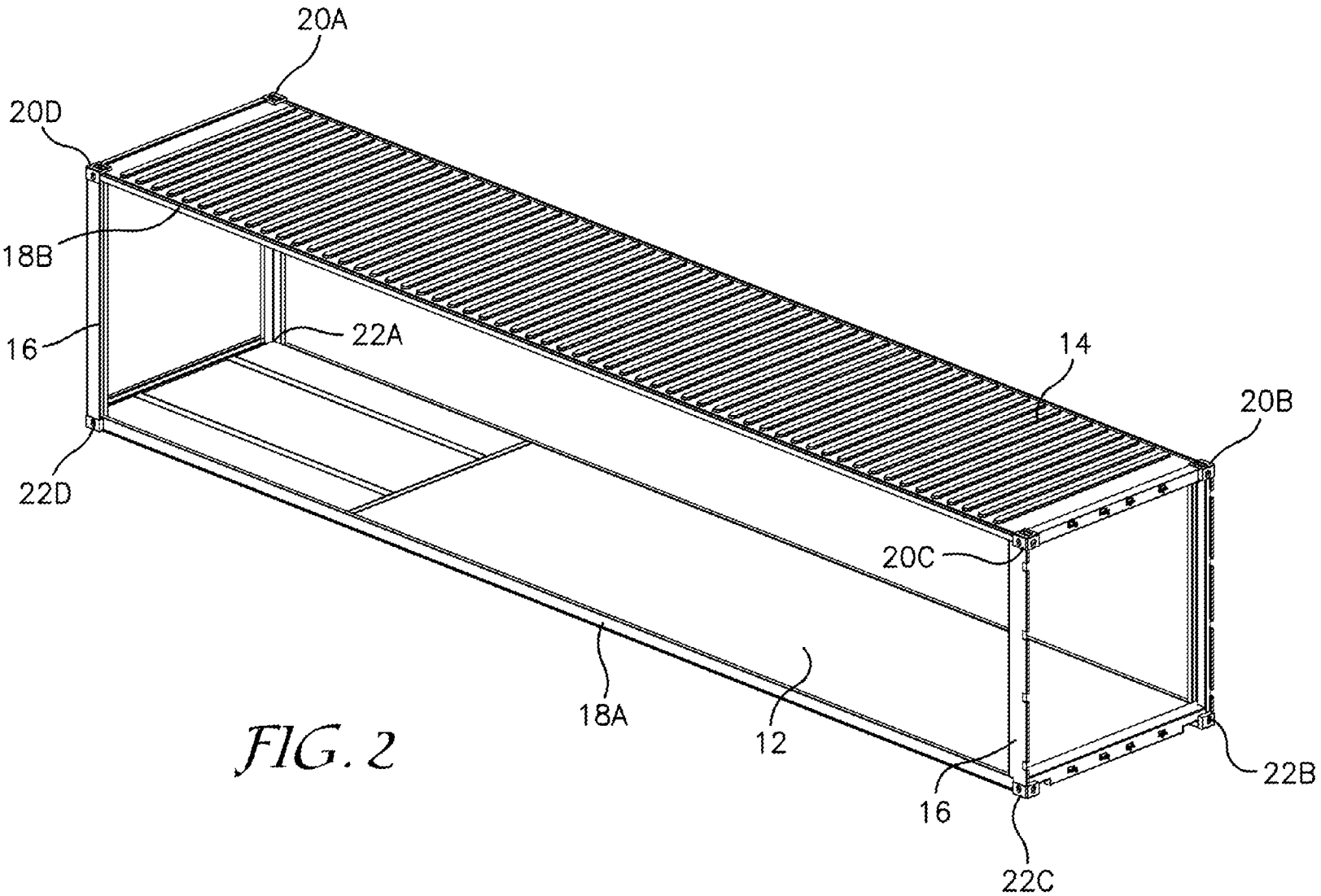
FIG. 2 illustrates an embodiment of a standard intermodal shipping container with side walls and doors removed.

FIG. 2 also illustrates the plurality of vertical members 16 providing support at the upper and lower four corners 20A-20D and 22A-22D; however, additional vertical support members may be employed if increased vertical loading is anticipated. Two sets of horizontal members 18A and 18B are contemplated with the lower set of horizontal members 18A at floor level and an upper set of horizontal members 18B at ceiling level. The walls 24A-D, as best illustrated at FIG. 1, of the module 10 are secured to both the horizontal members 18A, 18B which in turn are supported and held in position with the assistance of the plurality of vertically oriented structural members 16.

Figure 3:
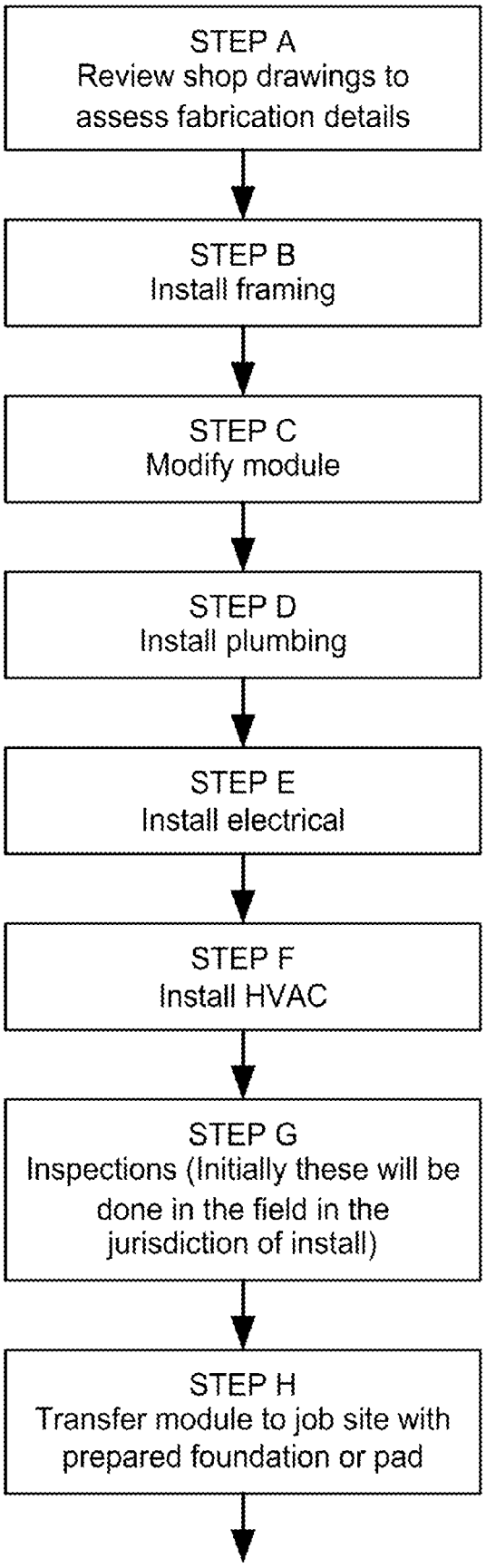
FIG. 3 illustrates a process flow diagram of the method of fabrication of the module and habitable structure.
Figure 3A:
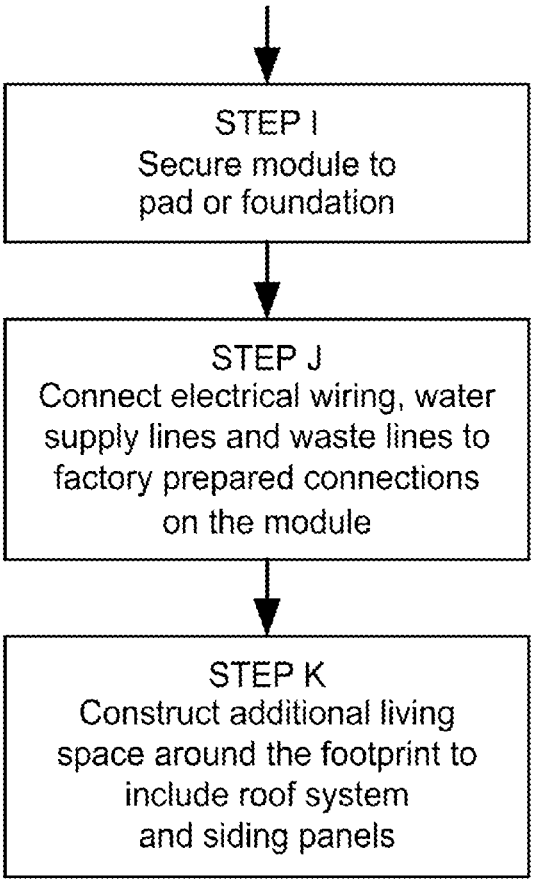
FIG. 3A illustrates a continuation of the process flow diagram of FIG. 3.

As identified by the process flow diagram at FIGS. 3 and 3A, in a first step A of the method of rapid fabrication of a module 10 for use in residential, commercial, and industrial construction, the fabricator reviews the shop drawings to assess fabrication details. This is critical so that the fabricator can align the fabrication steps with the requirements shown in the shop drawings. It is critical to have the appropriate tasks aligned so that work performed can occur in the proper sequence and materials that are installed do not have to be removed at later steps in the fabrication process.

Figure 4:
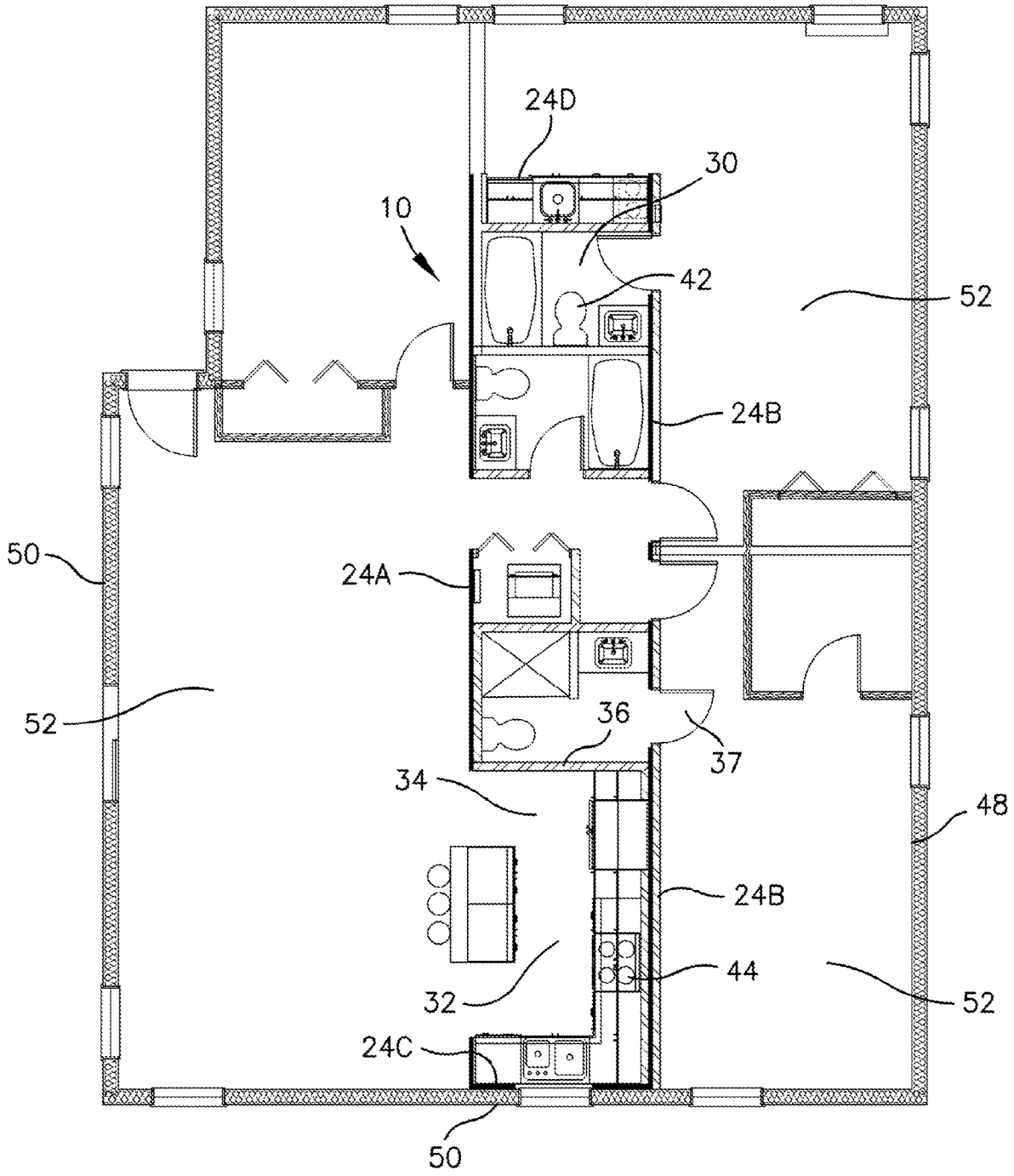
FIG. 4 illustrates a floor plan view with the module in position on a build site with habitable space surrounding the module.

The superintendent, or manager of the fabrication area, has responsibility for reviewing a set of shop drawings as generally illustrated at FIG. 4, to determine the required modifications and additions to the interior of the module 10 to install one or more bathrooms 30 and a kitchen 32 within the interior 34 of the module 10. The shop drawings are preferably prepared by an architect and provide considerable detail on the precise location of all components to be installed within the module 10.

Step B requires receiving the module 10 in the factory setting and commencing the framing of the module. The module comprises four walls 24A-D, a floor 12 and a ceiling 14. In step B, framing is installed within the module 10 consistent with the shop drawings. The framing, typically 2" wide by 4" high and 8' in length lumber provides the required support for sheet rock or other type of wall member 36 to, for example, segregate the one or more bathrooms 30 from the kitchen 32. The wall member 36 is secured to the framing members with fasteners, then mudded, sanded, and finally painted. Other types of wall members, such as wood, are also contemplated by this disclosure. Fabrication of doorways 37 into and out of the module 10 will also be incorporated into this step. It is contemplated that at least one doorway 37 will provide ingress and egress from the kitchen 32 of the module 10 and possibly additional means of ingress and egress may be incorporated into the finished module 10.

Step C requires modifying the module 10 as necessary by placing cutouts for doors and windows in the metal walls. Other cutouts in the floors and walls may also be needed for utility feeds such as for potable water, drain lines, electrical power lines and gas lines.

In step D, plumbing components 42 are installed consistent with the shop drawings. Plumbing components 42 includes, among potentially other items, toilets, sinks, drain lines, water supply lines, a shower and/or a bathtub. Framing as detailed at step B is disclosed as the first step in the fabrication of the interior of the module 10; however, it is contemplated that steps that are later outlined in this disclosure beyond step A may precede the installation of the framing. The order of fabrication set forth in this disclosure should not be interpreted to mean that there is only one permissible sequence of fabrication as many sequences are available for fabrication of the module 10.

In step E, electrical wiring components are installed within the module 10 consistent with the shop drawings. The electrical components 44 include among other items, wiring, electrical switches, electrical outlets, lighting, ranges and fans. These components 44 are installed in the traditional manner with wiring run through the framing and behind the wall member 36 positioned against the framing. For example, light switches are secured to framing and allowed to protrude through the wall member 36 for use by the occupant of the module 10.

Step F requires the installation of heating ventilation and cooling systems or subsystems. Duct work must be fabricated into the module and the duct work may be positioned and secured in a ceiling area or along the walls. In some limited circumstances blowers (for forced air) or auxiliary air conditioning units may be installed within the module. Often a gas fired (or possibly an oil fired) furnace may be installed within the module to accommodate colder climates.

Step G requires that during the framing, plumbing and electrical component installation an individual with appropriate licensure reviews all work to ensure that the installation of the plumbing and electrical components is performed in compliance with all applicable codes for the jurisdiction where the work is being performed or alternatively the location where the module 10 will finally be secured to a pad or foundation. Specifically, someone with the appropriate training, experience, and certification by the locality with jurisdiction over the skilled trade maintains authority for approving or rejecting any of the plumbing and electrical work performed by the unlicensed assembly personnel.

The inspector may be a journeyman electrician or plumber with, for example, 8,000 hours of on-the-job experience acquired over a four-year apprenticeship or by a master electrician or plumber that has acquired an additional 4,000 hours of work experience over the course of two years and passing a journeyman to master electrician or master plumber examination.

The licensed inspector, at the site of fabrication, is responsible for confirming that all work is performed in compliance with state, county or municipal regulations, codes, or ordinances. The inspector may be required by state or local law to inspect all work or possibly just some percentage of the work that is being performed by the unlicensed labor. Having a single or a very limited number of licensed individuals at the fabrication site to accept or reject the work that is done by unlicensed personnel lowers the overall fabrication costs for the finished habitable structure. A fabrication facility may, for example, produce twenty modules per day, however, only one licensed individual is required to review the work performed by the unlicensed individuals who are working at a lower hourly wage than the licensed inspector.

Figure 6:
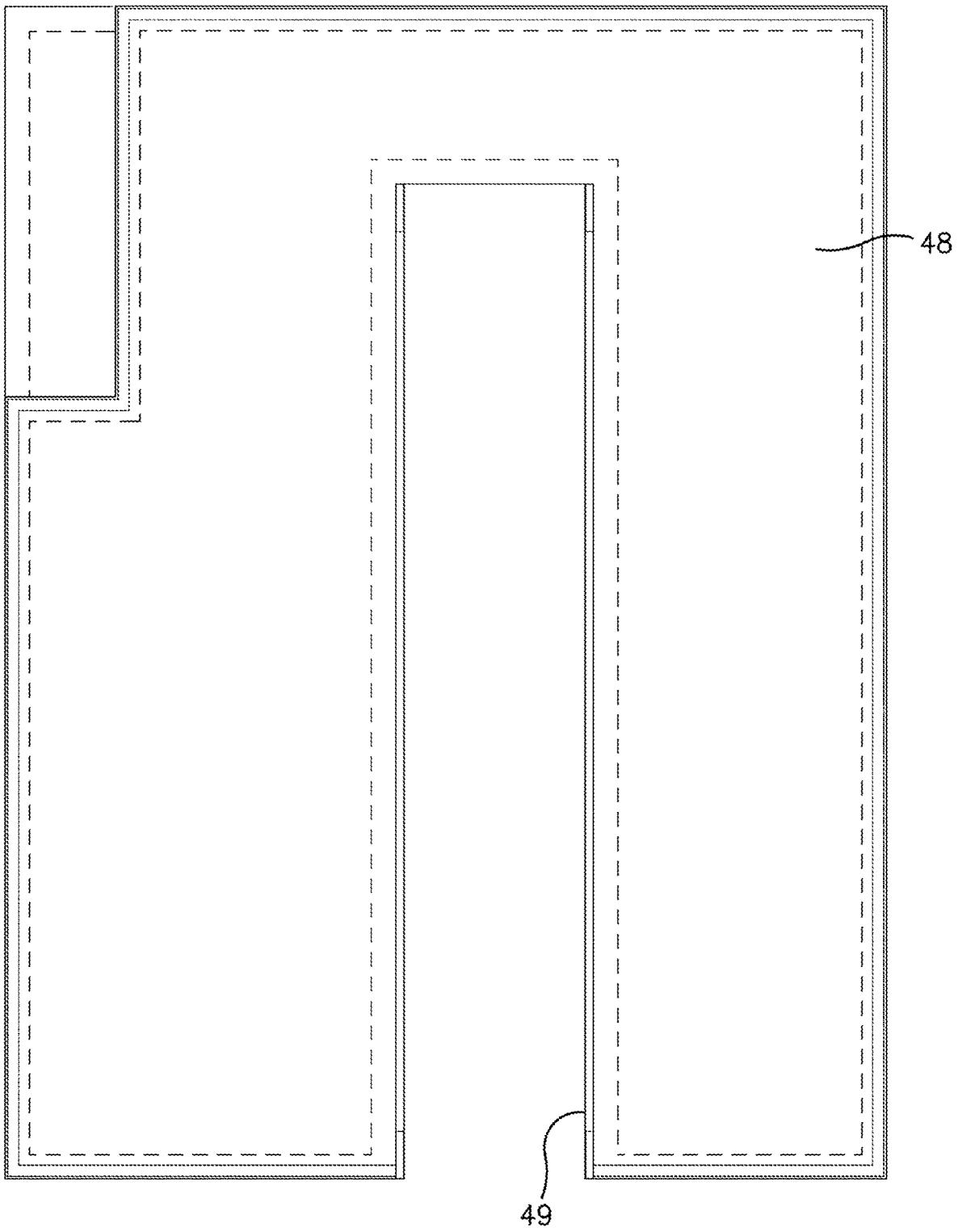
FIG. 6 illustrates an embodiment of a footprint of a habitable structure.

Step H requires transferring of the interiorly fabricated module 10 to a job site wherein at least one of a pad or a foundation 48 has been prepared such as illustrated by FIG. 6. The transfer of the interiorly fabricated module will typically be done by flatbed truck; however, if the distance to the final job site is significant and nearby rail services are available then transfer by rail may also be an option. The pad or foundation 48 comprise a concrete surface area larger than a footprint 49 of the module 10. This disclosure also contemplates a pier foundation with wooden floor joists. The surface area that is more than the footprint 49 of the module 10 is configured for additional living space 52 within the fully assembled habitable structure.

Step I requires securing the module 10 to a portion of the pad or foundation 48. The module 10 is positioned within the perimeter 50 of the pad or foundation 48 at a predetermined location. The area of the pad or foundation 48 where the module 10 will reside has been pre-plumbed with water supply lines, drain lines and a gas line to align with the connections in the module 10 making the lines easy to connect to one another. In addition, electrical wiring running to the pad or foundation 48 has been positioned to facilitate connection to the module 10.

Step J requires connecting the electrical wiring, water supply lines, wastewater lines and natural gas lines to the appropriate connection on the module. The module 10 will also preferably be anchored to the pad or foundation 48 with hurricane resistant fasteners if the location of the habitable structure is within a potential zone for impact by powerful winds from hurricanes or tornados.

Figure 5:
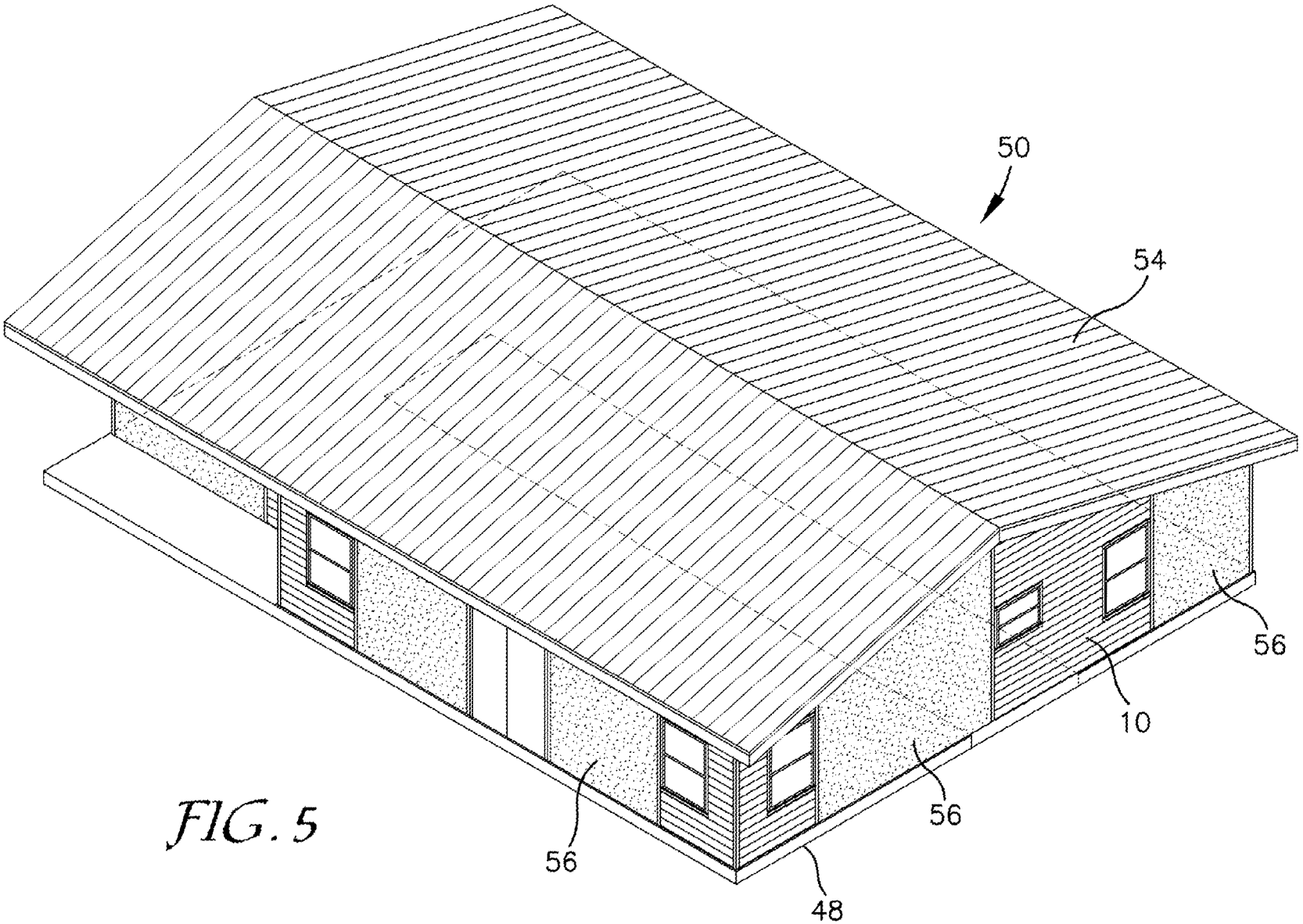
FIG. 5 illustrates an embodiment of a finished habitable structure.

Step K requires constructing additional living space 52 within the perimeter 50 of the pad or the foundation 48 as illustrated at FIG. 4. The additional living space 52, is covered, as illustrated at FIG. 5, by a roof system 54 that extends over the module 10 as well as all the living space 52 of the habitable structure including exterior wall members 56, which may be standard siding panels such as fiber cement, vinyl, composite or preferably an environmentally sustainable material. The methodology for erecting wall members 56 for a habitable structure is well known in the construction industry.

The exterior wall members 56 surrounding the living space 52 preferably comprise high carbon dioxide sequestration capable biogenic panels such as those fabricated from bamboo or other environmentally sustainable materials. Additionally, the wall members 56 are preferably compliant with Underwriters Laboratories (UL) standard 752 rated Level 1 penetration resistance such that they are capable of resisting penetration of a 9 mm full metal copper jacket round with a lead core projectile with a muzzle energy in the range of 386-460 foot-pounds. This feature is particularly important to homeowners locating in areas where crime and gunfire are ongoing issues of concern. The preferred wall members 56 also have an insulative R-value of at least 19 to provide robust energy conservation related to heating and cooling in areas with temperature and humidity extremes.

Preferred exterior wall members 56 also include a rabbet fitting that includes a groove cut into the side or end of a wall member 56 that strengthens the connection between the adjacent wall members 56. More precisely a rabbet fitting is an open-sided channel or recess along the edge or across the end of a wall member. The rabbet fitting assists in locating the wall members 56 during assembly, and the rabbet fitting also provides more of a mechanical connection than does a butt joint.

The exterior wall members 56 are also preferably compliant with California Building Standards Code (Title 24) section R703 such that the exterior envelope is designed and constructed in a manner that prevents the accumulation of water within the wall assembly by providing a water-resistant barrier behind the exterior paneling and a means of draining to the exterior the water that penetrates the exterior wall members such as siding. The preferred exterior wall member 56 is resistant to wind driven rain and water does not penetrate the rabbet fitting fabricated into the exterior wall members 56. The wall members 56 are also preferably capable of resisting wind loads in accordance with ASTM E330 titled *Standard Test Method for Structural Performance of Exterior Windows, Doors, Skylights and Curtain Walls by Uniform Static Air Pressure Difference.*

The wall members 56 disclosed herein also preferably can reduce low frequency sounds that enter a home. The outdoor/indoor transmission class (OITC) is a number rating of the sound transmission loss of a constructed assembly tested with lower frequencies to represent sound typical of modes of transportation. While a standard 2"×4" wood stud wall with drywall (2 sides) has an average OITC rating of 30-36 while the siding panels disclosed herein preferably have an OITC rating of 42. The higher the OITC rating means the higher the sound attenuation properties of the siding panel.

As illustrated at FIG. 4, the transferred and inspected module 10 comprises first and second longitudinally extending walls 24A, 24B and first and second laterally extending walls 24C, 24D. Only the first laterally extending wall 24C of the module 10 is adjacent the outer perimeter 50 of the foundation or pad as also illustrated at FIG. 4. The second laterally extending wall 24D and the first and second longitudinally extending walls 24A, 24B are disposed within the living space 52 of the habitable structure. Minimizing the surface area of the module 10 that must be sided with a wall member 56 reduces the cost of construction relative to the construction of a standard exterior wall and further allows the kitchen and the bathroom(s) to be disposed within the interior space of the structure thereby enhancing the safety of those spaces should a powerful wind event occur.

The disclosed method should not be construed as limiting in any way. Instead, the present disclosure is directed toward all novel and nonobvious features and aspects of the various disclosed embodiments, alone and in various combinations and sub-combinations with one another. The disclosed methods are not limited to any specific aspect or feature or combination thereof, nor do the disclosed embodiments require that any one or more specific advantages be present, or problems be solved.

In view of the many possible embodiments to which the principles of the disclosed invention may be applied, it should be recognized that the illustrated embodiments are only examples of the disclosure and should not be taken as limiting the scope of the invention. Rather, the scope of the invention is defined by the following claims. I therefore claim as my invention all that comes within the scope of these claims.

The disclosure presented herein is believed to encompass at least one distinct invention with independent utility. While the at least one invention has been disclosed in exemplary forms, the specific embodiments thereof as described and illustrated herein are not to be considered in a limiting sense, as numerous variations are possible. Equivalent changes, modifications, and variations of the variety of embodiments, materials, compositions, and methods may be made within the scope of the present disclosure, achieving substantially similar results. The subject matter of the at least one invention includes all novel and non-obvious combinations and sub-combinations of the various elements, features, functions and/or properties disclosed herein and their equivalents.

Benefits, other advantages, and solutions to problems have been described herein regarding specific embodiments. However, the benefits, advantages, solutions to problems, and any element or combination of elements that may cause any benefits, advantage, or solution to occur or become more pronounced are not to be considered as critical, required, or essential features or elements of any or all the claims of at least one invention.

Many changes and modifications within the scope of the instant disclosure may be made without departing from the spirit thereof, and the one or more inventions described herein include all such modifications. Corresponding structures, materials, acts, and equivalents of all elements in the claims are intended to include any structure, material, or acts for performing the functions in combination with other claim elements as specifically recited. The scope of the one or more inventions should be determined by the appended claims and their legal equivalents, rather than by the examples set forth herein.

Benefits, other advantages, and solutions to problems have been described herein regarding specific embodiments. Furthermore, the connecting lines, if any, shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions.

The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

In the detailed description herein, references to "one embodiment," "an embodiment," "an example embodiment," etc., indicate that the embodiment described may include a feature, structure, or characteristic, but every embodiment may not necessarily include the feature, structure, or characteristic. Moreover, such phrases are not necessarily referring to the same embodiment. Further, when a feature, structure, or characteristic is described relating to an embodiment, it is submitted that it is within the knowledge of one skilled in the art to affect such feature, structure, or characteristic relating to other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. § 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention has been described above with reference to one or more preferred embodiments, it will be appreciated that various changes or modifications may be made without departing from the scope of the invention as defined in the appended claims.

We claim:

1. A method for the construction of a habitable structure; the method comprising:

receiving or fabricating a module, the module comprising four walls, a ceiling and a floor;

reviewing a set of shop drawings to determine the required modifications to the module to fabricate at least one bathroom and a kitchen within the interior of the module;

installing framing within the module consistent with the shop drawings;

installing plumbing components in the module consistent with the shop drawings;

installing electrical wiring components within the module consistent with the shop drawings;

inspecting all installed plumbing and electrical components by an individual with appropriate licensure to ensure compliance with all applicable codes;

transferring the inspected module to a job site, wherein at least one of a pad or a foundation has been prepared at the job site and the pad or foundation comprises a surface area larger than a footprint of the module, the surface area in excess of the footprint of the module configured for additional living space within the habitable structure;

securing the module to at least one of a portion of the pad or foundation;

connecting the electrical and plumbing components to the module; and constructing additional living space around the footprint of the module and within the perimeter of the pad or the foundation, the constructing comprising erecting exterior wall members at the footprint, the exterior wall members formed from panels that, in a single installed panel assembly simultaneously (i) comply with Underwriters Laboratories (UL) Standard 752 rated Level 1 penetration resistance and are capable of resisting penetration of a 9 mm full metal copper jacket projectile with a lead core and a muzzle energy in the range of 380-460 foot-pounds, (ii) provide an Outside-Inside Transmission Class (OITC) rating of ≥42, and (iii) demonstrate compliance with Title 24 for a building envelope of the habitable structure.

2. The method of claim 1, wherein the plumbing components comprise at least one of sinks, toilets, showers, dishwashers, clothes washers, bathtubs, drain lines, water supply lines, furnaces, A/C units and natural gas lines.

3. The method of claim 1, wherein the electrical components comprise at least one of electrical wiring, light switches, outlets, fans, breaker boxes, furnaces, A/C units and lighting.

4. The method of claim 1, wherein the step of constructing additional living space comprises erecting wall members at the footprint of the habitable structure.

5. The method of claim 1, wherein the step of constructing additional living space around the footprint comprises attaching a roof system to the habitable structure that extends over the module.

6. The method of claim 4, wherein the wall members comprise high carbon dioxide sequestration capable biogenic panels.

7. The method of claim 4, wherein the high carbon dioxide sequestration capable biogenic wall members comprise members fabricated from environmentally sustainable materials.

8. The method of claim 4, wherein the wall members comprise an insulative R-value of at least 19.

9. The method of claim 1, wherein the transferred and inspected module comprises first and second longitudinally extending walls and first and second laterally extending walls.

10. The method of claim 9, wherein only the first laterally extending wall of the module is adjacent an outer perimeter of the foundation or pad.

11. The method of claim 9, wherein the second laterally extending wall and the first and second longitudinally extending walls are disposed within an interior of the habitable structure.

12. The method of claim 1, wherein appropriate licensure is licensure authorizing an individual to maintain, modify, install as well as oversee the maintenance, modification, and installation of electrical and plumbing components in a particular jurisdiction.

13. The method of claim 1, wherein applicable codes are those regulations and ordinances in each jurisdiction directed to the installation of plumbing, electrical, heating, cooling and ventilation apparatuses.

14. The method of claim 1, wherein the module comprises space for at least one of a dehumidifier, a solar panel inverter and batteries.

15. The method of claim 4, wherein the wall members are capable of resisting wind loads in compliance with ASTM E330 titled Standard Test Method for Structural Performance of Exterior Windows, Doors, Skylights and Curtain Walls by Uniform Static Air Pressure Difference.

* * * * *